US006926492B2

(12) United States Patent
Hegebarth

(10) Patent No.: US 6,926,492 B2
(45) Date of Patent: Aug. 9, 2005

(54) SUCTION HOUSING FOR ROTOR/STATOR PUMP

(75) Inventor: Donald C. Hegebarth, Naperville, IL (US)

(73) Assignee: ChemGrout, Inc., LaGrange Park, IL (US)

( * ) Notice: Subject to any disclaimer, the term of this patent is extended or adjusted under 35 U.S.C. 154(b) by 16 days.

(21) Appl. No.: 10/690,057

(22) Filed: Oct. 21, 2003

(65) Prior Publication Data

US 2005/0084366 A1 Apr. 21, 2005

(51) Int. Cl.[7] ..... F04D 29/52
(52) U.S. Cl. ..... 415/72; 415/126; 415/111
(58) Field of Search ..... 415/72, 73, 111, 415/126

(56) References Cited

U.S. PATENT DOCUMENTS 3,467,018 A * 9/1969 Presson ..... 415/72
4,185,839 A * 1/1980 Allen ..... 277/520
4,237,704 A * 12/1980 Varadan ..... 418/48
5,507,630 A 4/1996 Hegebarth
6,123,445 A 9/2000 Grassi

OTHER PUBLICATIONS

Robbins & Myers MOYNO pump.

* cited by examiner

*Primary Examiner*—Ninh H. Nguyen
(74) *Attorney, Agent, or Firm*—Emrich & Dithmar LLC

(57) ABSTRACT

A pump of the rotor/stator type for wet cementitious material includes a suction housing for receiving and directing the material into a rotor/stator combination for delivery to the location of use. The suction housing is in the form of a rectangular closed structure having a material receiving flange and enclosing coupling between a drive shaft and an end of a rotor. The housing includes top, bottom and side panels, one of which includes the aforementioned material receiving flange. Each of the panels is easily removed from the suction housing to facilitate cleaning and removal of material residue after use, as well as maintenance and repair of the pump. Cementitious material may be introduced through either the top, bottom or either of the side panels by appropriate positioning of the material receiving flange. The pump further includes a lubricant reservoir for lubricating the drive shaft to extend pump operating lifetime.

16 Claims, 5 Drawing Sheets

SUCTION HOUSING FOR ROTOR/STATOR PUMP

FIELD OF THE INVENTION

This invention relates generally to pumps of the rotor/stator type such as used for cementitious material and is particularly directed to an improved suction housing and other improvements for use in a rotor/stator-type pump.

BACKGROUND OF THE INVENTION

Pumps are commonly used for directing cementitious material, such as of the grouting type, to the location of use of the material. The cementitious material is typically transported and injected under pressure by means of a progressing cavity-type pump comprised of a helical rotor rotating within an elongated, contoured stator which is internally lined with an elastomer. A relatively compact, closed chamber known as a suction housing is disposed between and connects the input end of the rotor/stator combination with a conventional drive arrangement incorporating a motor with a rotationally displaced drive shaft. The closed suction housing is adapted to receive the wet cementitious material such as under a hydrostatic head and deliver it to the input end of the rotor/stator combination in a manner which eliminates the possibility of foreign material entering the pump during the pumping process. Pumps used for these applications are known as "closed throat" type pumps, and are available from various manufacturers. Pumps of this type direct the cementitious material to the location of application which frequently affords only limited accessibility.

Referring to FIG. 1, there is shown a partially cutaway perspective view of a prior art rotor/stator pump 10 which the present invention provides various improvements over. The rotor/stator pump 10 is generally in the form of an elongated, hollow tube and includes an inlet/drive stage 14 and a pumping stage 17. The inlet/drive stage 14 and pumping stage 17 are connected to various mounting/support brackets 11*a*, 11*b* and 11*c* which provide stable positioning for the rotor/stator pump 10 and allow it to be connected such as by bolts to a support structure which is not shown in the figure for simplicity. The inlet/drive stage 14 is comprised of a bearing housing 15 and a suction housing 19 which in the arrangement shown in FIG. 1 is formed as a single cast piece preferably comprised of aluminum. Disposed within and extending from the bearing housing 15 is a drive shaft 18 which is connected to a source of rotary power which also is not shown in the figure for simplicity. Disposed about and engaging the drive shaft 18 within the bearing housing 15 is the combination of a thrust bearing 20 and a radial ball bearing 22 to facilitate rotational displacement of the drive shaft. Also disposed about and engaging the drive shaft 18 and located generally within the suction housing 19 is the combination of a packing gland 24, packing 26 and a lantern ring 28 which form a seal between the suction housing and inlet/drive stage 14. Other conventional components are disposed within bearing housing 15, but are not discussed herein as these components are well known to those skilled in the relevant arts.

Attached to the suction housing 19 is an apertured inlet flange, or collar, 16 through which a wet cementitious material is deposited into the suction housing for introduction into a stator frame, or transport tube, 12. Cementitious material introduced into the suction housing 19 via inlet flange 16 typically flows under the influence of a hydrostatic head arising from the weight of the cementitious material. Drive shaft 18 is connected to an inner end hub of a rotor 32 within the suction housing 19 by means of a connecting rod 30. Opposed ends of the connecting rod 30 are pivotally coupled to the drive shaft 18 and the inner end hub of rotor 32 in a pivoting manner which allows the rotor hub to follow an elliptical path as it is rotated by the drive shaft 18. Connecting rod 30 thus imparts rotation to rotor 32, while allowing the rotor hub to follow an elliptical path above the axis of rotation. As rotor 32 is rotationally displaced, cementitious material is drawn out of the suction housing 19 and into the space between the rotor 32 and stator 34 and is displaced along the rotor/stator combination for discharge through an aperture 36 in the distal end 12*a* of the stator frame 12. A bolt 23 disposed in a lower portion of the suction housing 18, when removed, allows for discharge during cleaning of residue remaining within the rotor/stator pump 10 following use. Cleaning of the rotor/stator pump 10 after each use is essential for continued pump operation because of the cementitious composition of the material introduced into and displaced by the pump, but is very difficult to carry out in this prior art pump.

These types of pumps suffer from three basic recurrent problems. The problems arise from the limited access afforded by the pump's closed suction housing. First, pumps of this type are difficult to clean and maintain, as well as to disassemble for inspection or repair. For example, when the rotor is turning, its hub describes an elliptical path. Thus, a connection between the rotor's hub and an input drive shaft requires that this type of motion be accommodated. In the standard pump design, this is accomplished by means of a connecting rod disposed within a tubular drive shaft, one end of which is pinned to an end of the tubular drive shaft, while a second opposed end of the connecting rod is pinned to an end of the rotor hub. The connecting rod imparts rotation to the rotor, while also describing the elliptical path of the rotor hub. The standard design leaves the end of the drive shaft open and exposed to the product being pumped. This allows some of the product deposited in the suction housing to enter an end of the drive shaft. Because the product is a cementitious material, it often forms a solid mass within the drive shaft. This renders the connecting rod immobile resulting in excessive stator wear, and makes disassembly of the pump for inspection and/or maintenance difficult, if not impossible. This unfortunate situation also invariably results in reduced pump operating lifetime.

The present invention addresses the aforementioned limitations of the prior art by providing an improved suction housing for a rotor/stator pump used with cementitious materials which is easily disassembled to facilitate cleaning, inspection and repair of the pump. This invention also contemplates additional improvements which increase the reliability and prolong the operating lifetime of these types of pumps.

OBJECTS AND SUMMARY OF THE INVENTION

Accordingly, it is an object of the present invention to provide an improved pump for cementitious material which is easily cleaned and repaired, has an increased operating lifetime, and is of simplified design and construction.

It is another object of the present invention to provide a suction housing for a rotor/stator pump which is easily disassembled to provide access to a drive shaft/rotor combination to facilitate pump cleaning and repair.

Yet another object of the present invention is to provide lubrication for the moving parts of a rotor/stator pump for increasing pump reliability and extending its operating lifetime.

A still further object of the present invention is to provide increased operating flexibility for a rotor/stator pump such as for cementitious materials for use in a wide range of operating environments.

This invention contemplates an improved suction housing for use in a progressing cavity pump of the rotor/stator type having removable panels which facilitates cleaning and maintenance of the pump as well repair or replacement of worn or damaged pump components. This invention further contemplates lubricating the pump's drive shaft for improved pump reliability and longevity, while allowing cementitious material to be delivered to the location of application with greater positioning flexibility than heretofore available.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 2:
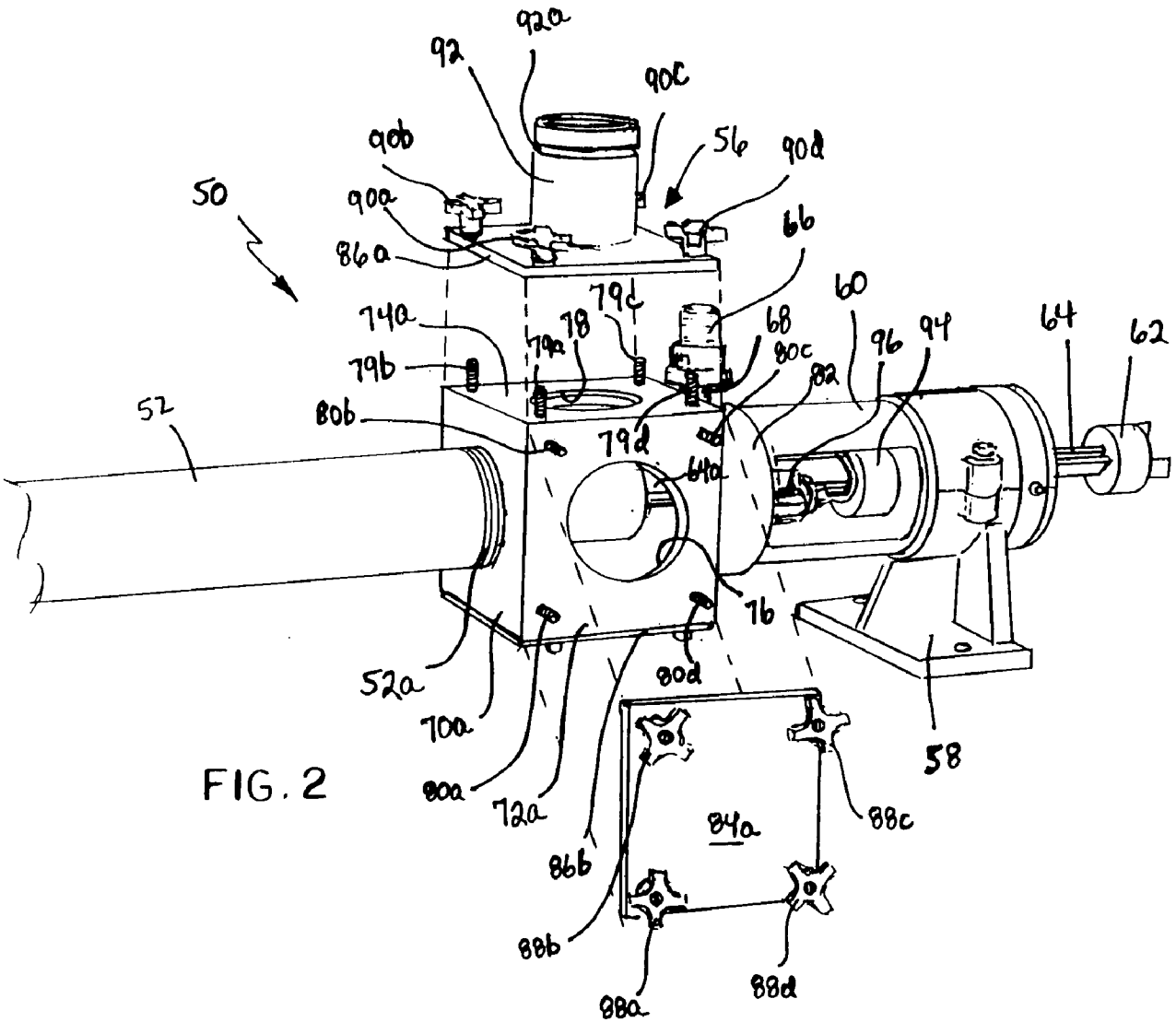
FIG. 2 is a partially cutaway and exploded perspective view of a rotor/stator pump in accordance with the principles of the present invention.
Figure 3:
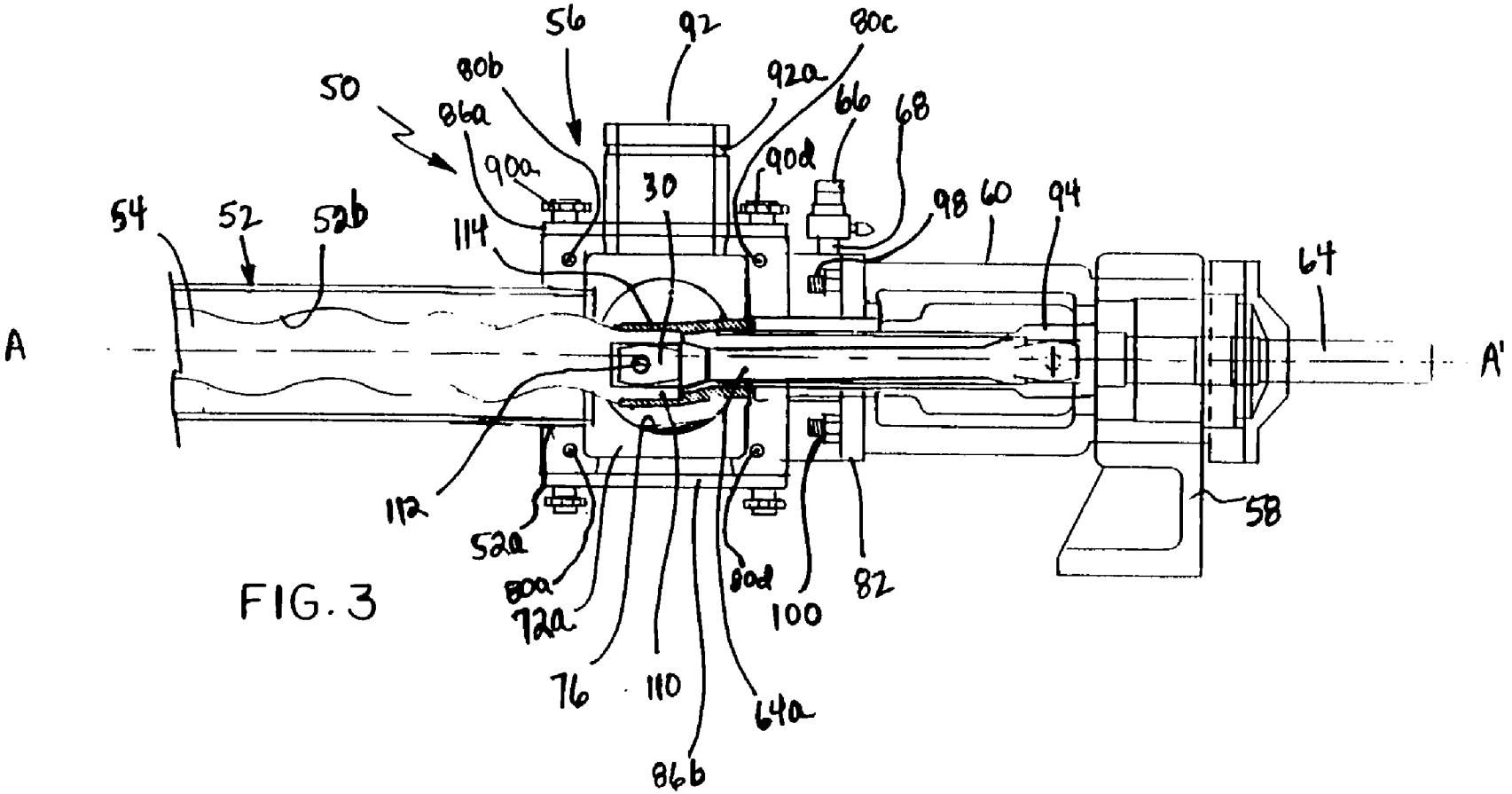
FIG. 3 is a longitudinal sectional view of the inventive rotor/stator pump shown in FIG. 2.

Referring to FIG. 2, there is shown a partially cutaway and exploded perspective view of a rotor/stator pump 50 in accordance with the principles of the present invention. FIG. 3 is a longitudinal sectional view of the inventive rotor/stator pump 50 shown in FIG. 2, while FIG. 4 is a perspective view of the inventive rotor/stator pump illustrating additional details of its suction housing 56 and lubricant reservoir 66.

As in the previously described prior art approach, rotor/stator pump 50 includes a stator frame 52 and a bearing housing 60. The rotor/stator pump 50 includes plural pump mounting/support brackets 58, although only one such bracket is shown in FIG. 2 for simplicity. The pump mounting/support bracket 58 is attached to the bearing housing 60 by conventional means such as a clamping structure with attaching bolts as shown in FIG. 2. Disposed between and attached to the stator frame 52 and bearing housing 60 is a suction housing 56. Suction housing 56 is attached to a first input end of the stator frame 52 by means of a threaded end portion 52*a* on the stator frame. Suction housing 56 is further connected to an end of the bearing housing 60 by means of a coupling flange 82 as described in detail below.

Figure 1:
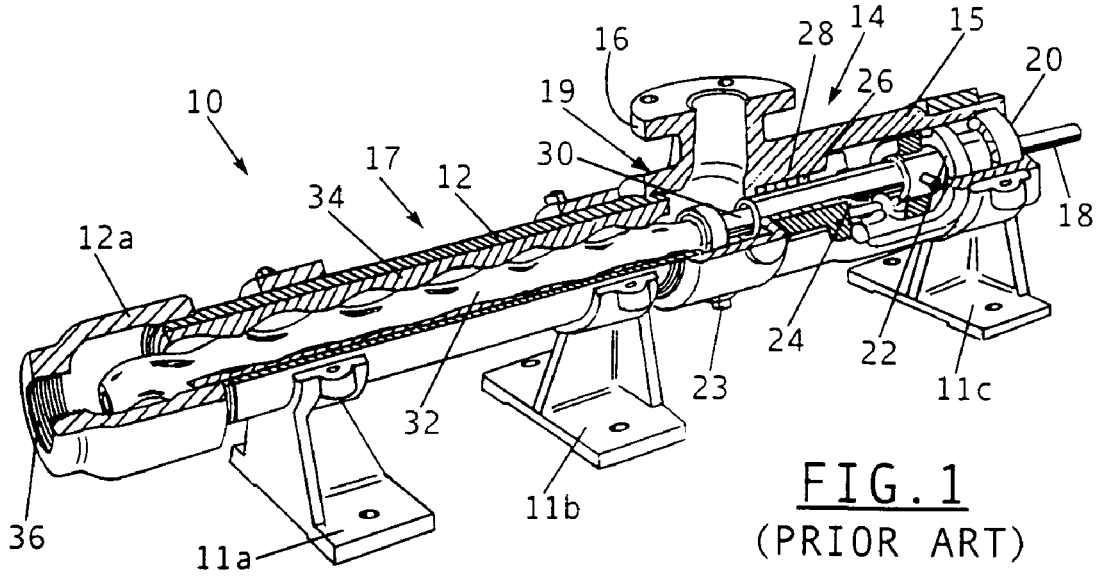
FIG. 1 (PRIOR ART)
FIG. 1 is a partially cutaway perspective view of a prior art rotor/stator pump.

Stator frame 52 and bearing housing 60 and the contents thereof are conventional in design and operation. Thus, stator frame 52 has an inner surface in the form of a stator 52*b* incorporating an elastomer and a rotor 54 disposed within the stator frame and extending the length thereof. Bearing housing 60 has disposed therein and extending the length thereof a drive shaft 64. Attached to one end of drive shaft 64 is an adapter 62 for facilitating attachment of the drive shaft to conventional rotary drive means such as an electric, gas or hydraulic motor. Disposed within the bearing housing 60 and engaging the drive shaft 64 are various conventional components to facilitate rotational displacement of the drive shaft within the bearing housing such as previously described with regard to the prior art rotor/stator pump 10 of FIG. 1 as well as a shaft collar 94 and a packing gland 96 as shown in FIG. 2.

Figure 4:
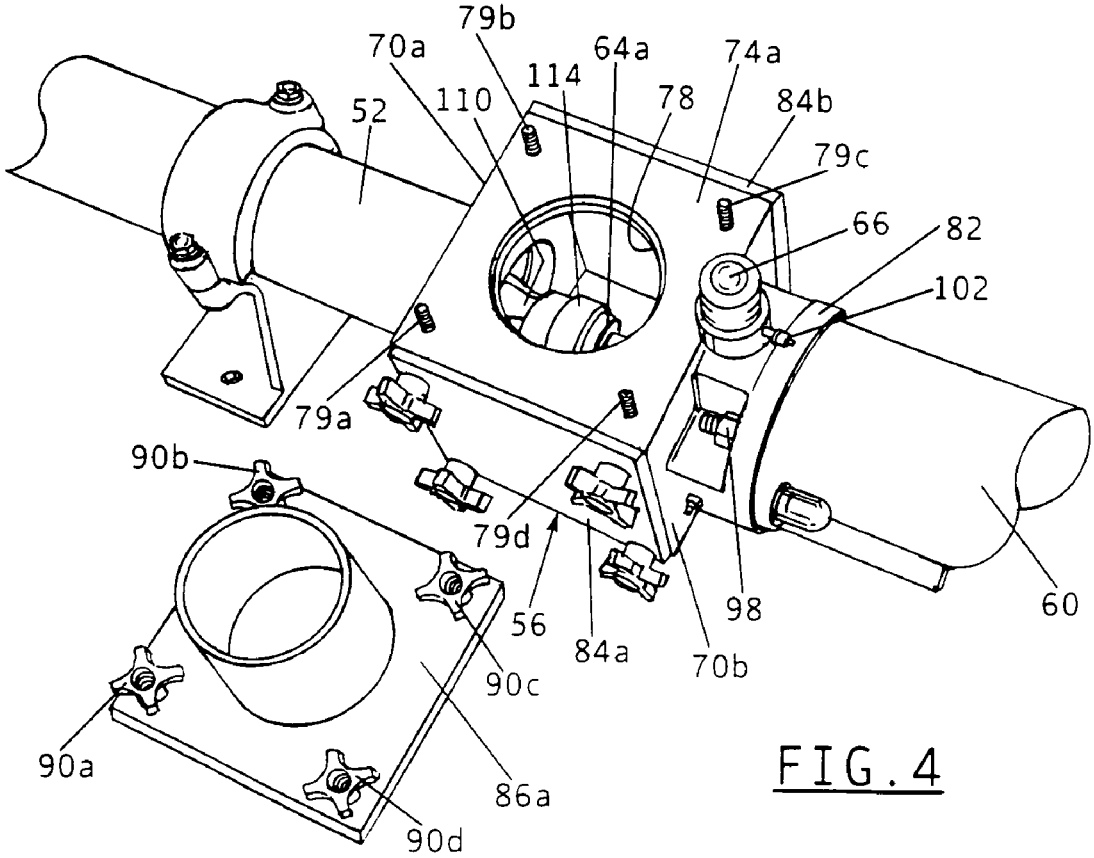
FIG. 4 is an upper perspective view of a suction housing for use in a rotor/stator pump in accordance with one aspect of the present invention, where one of the suction housing's cover plates has been removed to illustrate additional details of the invention.

Suction housing 56 includes a front panel 70*a* and a back panel 70*b* having attached thereto the aforementioned coupling flange 82 as shown in FIG. 4. Coupling flange 82 is securely connected in a sealed manner to an end of the bearing housing 60 by conventional means such as plural nut and bolt combinations, where only three such combinations are shown in the figures as elements 98, 100 and 102. Suction housing 56 further includes first and second side panels 72*a* and 72*b*, and top and bottom panels, where the top panel is shown as element 74*a*. Suction housing 56 is generally rectangular in shape, with each of the first and second side panels 72*a*, 72*b* and top and bottom panels including a respective generally circular aperture therein. Thus, as shown in FIGS. 2 and 3, the first side panel 72*a* includes aperture 76, while as shown in FIG. 4 top panel 74*a* includes aperture 78. Each of the aforementioned panel apertures allows for access to the inner portion of the suction housing 56 and the various components disposed therein to facilitate cleaning of the rotor/stator pump 50 and/or repairing or replacing pump components when needed. Each of the first and second side panels 72*a*, 72*b* and top and bottom panels includes plural threaded pins therein for attaching a cover plate to the panel. Thus, as shown in FIGS. 2 and 3, the first side panel 72*a* includes four threaded mounting pins 80*a*–80*d*. Similarly, as shown in FIG. 4, the top panel 74*a* includes four threaded mounting pins 79*a*–79*d*. Each of the aforementioned sets of threaded mounting pins on a respective panel allows a cover plate to be attached to the panel so as to cover the generally circular aperture in the panel and render the suction housing 56 fully enclosed and sealed. Thus, each of four apertures within a first side cover plate 84*a* is adapted to receive one of the respective mounting pins 80*a*–80*d* for positioning the cover plate on the panel. First through fourth threaded connectors 88*a*–88*d* are respectively adapted to engage the first through fourth mounting pins 80*a*–80*d* for securely attaching the first cover plate 84*a* on the first side panel 72*a* in a sealed manner. Similarly, four threaded mounted pins 79*a*–79*d* disposed on the top panel 74*a* are adapted for insertion within respective apertures in a top cover plate 86*a* for secure attachment to the top panel by means of four threaded connectors 90*a*–90*d*. A second side cover plate 84*b* and a bottom cover plate 86*b* are similarly adapted for attachment to the second side panel 72*b* and the bottom panel, respectively, in a sealed manner.

Figure 5:
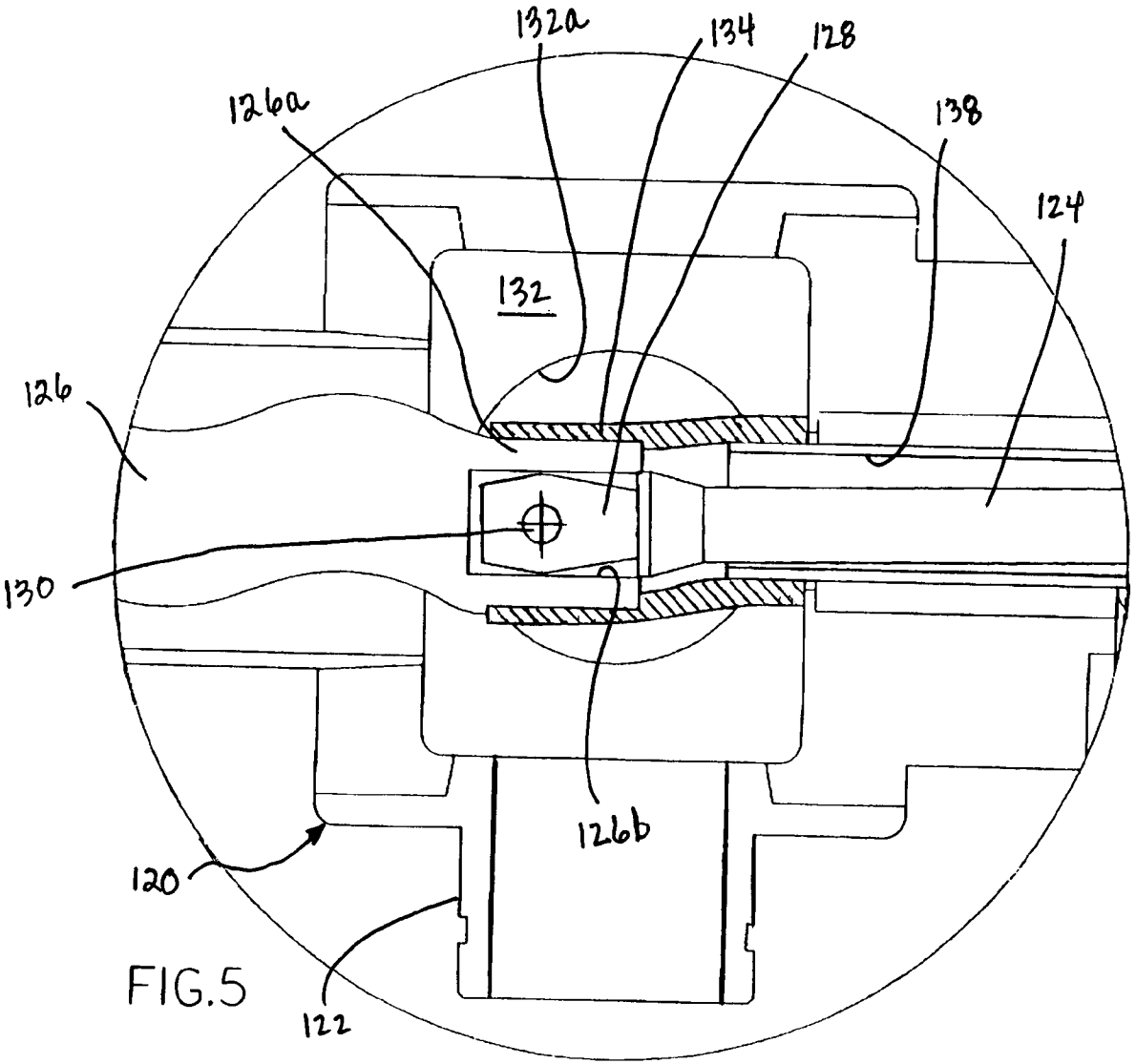
FIG. 5 is a partial sectional view of the inventive rotor/stator pump illustrating details of the manner in which a sealed connection is provided between the pump's drive shaft and the rotor's hub.

Referring to FIG. 5, there is shown additional details of the manner in which an intermediate portion of a drive shaft 124 is connected to the hub 126*a* of a rotor 126 in a sealed manner in accordance with another aspect of the present invention. FIG. 5 is a sectional view of the suction housing 120 taken along the longitudinal center axis A–A' shown in FIG. 3 of the rotor/stator pump within which the suction housing is disposed. Shown in FIG. 5 is a suction housing 120 in accordance with another aspect of the present invention having an inlet tube 122 attached to a lower portion of the housing to facilitate introduction of cementitious material in the suction housing. Suction housing 120 also includes a side panel 132 having a generally circular aperture 132*a* therein. The intermediate portion of drive shaft 124 is connected to rotor hub 126*a* located on the end of rotor 126 by means of the combination of a connecting rod 130 and a connecting rod 128. Connecting rod 128 is also connected to the end of intermediate portion of drive shaft 124 by means of a second connecting pin 136 shown in the figure in dotted line form. As described above, as the rotor turns, the rotor's hub 126*a* moves in an elliptical path in a plane transverse to the longitudinal axis of the rotor/stator pump. This dual connecting pin coupling arrangement between the rotor's hub 126*a*, connecting rod 130 and the intermediate portion of drive shaft 124 allows for elliptical displacement of the rotor's hub. The off-axis positioning of the connection between the intermediate portion of the drive shaft 124 and the rotor's hub 126*a* is shown in FIG. 3, where the connecting pin 112 between the rotor's hub and the connecting rod 30 is shown disposed below the longitudinal axis center A–A' of the rotor/stator pump.

Also in accordance with the present invention, there is shown in FIG. 5 a shaft sealing gasket 134 disposed about adjacent portions of the rotor's hub 126*a* and the intermediate portion of drive shaft 124. The end of the shaft sealing gasket 134 is securely positioned over a drive shaft slot 138 within the suction housing 120 and enclosing the intermediate portion of drive shaft 124. Shaft sealing gasket 134 prevents cementitious material deposited in the suction housing 120 from entering an end slot 126*b* within the rotor's hub 126*a* and from coming in contact with various pump components such as connecting pin 130 and connecting rod 128 connecting the intermediate portion of drive shaft 124 to the rotor's hub. Thus, this connection between the intermediate portion of drive shaft 124 and the rotor's hub 126*a* does not have to be cleaned out after each use of the rotor/stator pump. This sealed arrangement for the aforementioned drive components of the rotor/stator pump also increases the reliability and prolongs the operating lifetime of the rotor/stator pump. The previously discussed longitudinal sectional view of FIG. 3 also shows a hollow, cylindrical sealing gasket 114 disposed about and connecting adjacent end portions of the hub 110 of rotor 54 and the intermediate portion 64*a* of drive shaft 64 in a manner which prevents cementitious material deposited in suction housing 56 from coming in contact with the connected portions of the rotor and drive shaft and the connection therebetween.

Figure 6:
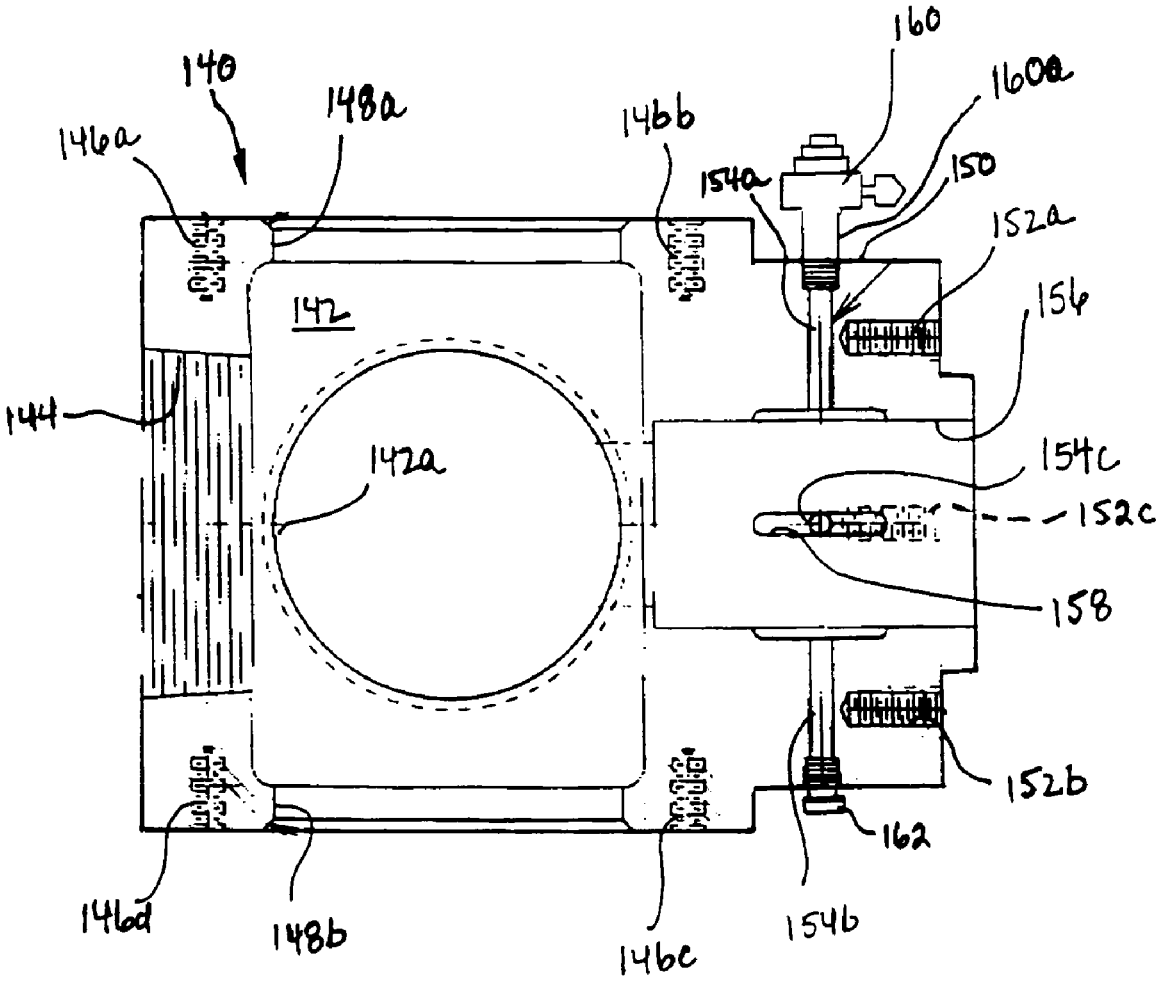
FIG. 6 is a sectional view shown partially in phantom of the suction housing contemplated for use in a rotor/stator pump in accordance with the present invention.

Referring to FIG. 6, there is shown a sectional view of suction housing 140 in accordance with the present invention illustrating additional features of the suction housing. Suction housing 140 includes a side panel 142 having a generally circular aperture 142*a* therein as previously described. Each of the top and bottom as well as the two lateral surfaces of the suction housing 140 are provided with four threaded slots for receiving threaded mounting pins for attaching a respective cover plate to each of these outer surfaces of the suction housing. Four of these threaded slots 146*a*–146*d* are shown in dotted line form in the sectional view of FIG. 6. Also, a front portion of the suction housing 140 is provided with an enlarged threaded aperture 144 for receiving a threaded end of the stator frame which is not shown in the figure for simplicity.

Disposed on an aft portion of suction housing 140 is a coupling flange 150 for connecting the suction housing to a bearing housing also as previously described. Plural threaded slots 152*a*, 152*b* and 152*c* are provided in the coupling flange 150 for connecting the suction housing 140 to the bearing housing (not shown for simplicity). A fourth threaded slot is provided in the coupling flange 150 for this purpose, but is not shown in FIG. 6 for simplicity. Also disposed within the coupling flange 150 is a larger, generally circular slot 156, within which the drive shaft is disposed and which is adapted for also receiving aforementioned conventional components such as a lantern ring and packing rings for forming a seal between the suction housing 140 and a bearing housing to which it is attached. To facilitate rotation of a drive shaft extending through these various sealing components within the coupling flange's circular slot 156, a lubricant reservoir 160 is connected to the coupling flange 150 by means of a threaded connection. Lubricant reservoir 160 includes a connecting tube 160*a* having a threaded distal end to facilitate connection to a lubricant slot 154*a* within the coupling flange 150. Three additional lubricant slots are provided for within the coupling flange 150 to accommodate various orientations of the suction housing 140 during operation, where two of these additional lubricant slots are shown as elements 154*b* and 154*c* in FIG. 6. Lubricant reservoir 160 is disposed on an upper portion of the coupling flange 150 to allow lubricant to flow into the coupling flange's circular slot 156 during pump operation. Lubricant reservoir 160 provided lubricant to the aforementioned sealing components such as the lantern and packing rings to facilitate rotation of the drive shaft within the suction housing's coupling flange 150. Elongated, linear slots 158 in the coupling flange 150 are each aligned with a respective lubricant slot to permit lubricant to be distributed over the full width of the lantern ring and plural adjacent packing rings. Finally, a threaded member such as a bolt is inserted in each of the lubricant slots not connected to the lubricant reservoir 160, as shown for the case of threaded member 162 connected to lubricant slot 154*b*, to prevent leakage of lubricant from the suction housing's coupling flange 150.

While particular embodiments of the present invention have been shown and described, it will be obvious to those skilled in the relevant arts that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A pump for cementitious material comprising:

a sealed drive stage capable of imparting rotary motion;

a rotor/stator mechanism including a rotor disposed within a stator for displacing cementitious material within and along the length of said stator as said rotor undergoes rotational displacement;

a connector coupling said drive stage to said rotor/stator mechanism for rotationally displacing said rotor; and a sealed suction housing enclosing said connector and including front and aft walls adapted for connection respectively to said rotor/stator mechanism and to said drive stage and adapted to receive cementitious material, wherein rotation of said rotor by said drive stage draws cementitious material from said suction housing for displacement within and discharge from said rotor/stator mechanism, said suction housing including plural removable side plates for exposing said connector and an inner portion of said suction housing to facilitate cleaning and repair of the pump.

2. The pump of claim 1 further comprising plural coupling members connecting each of said removable plates to said suction housing.

3. The pump of claim 2 wherein each of said removable plates includes plural apertures each adapted to receive a respective coupling member.

4. The pump of claim 3 wherein each coupling member includes a threaded pin attached to said suction housing and adapted for insertion through a respective aperture in a plate, each coupling member further including a threaded connector for engaging a respective threaded pin for securely maintaining a plate on said suction housing in a sealed manner.

5. The pump of claim 4 wherein said suction housing further includes top, bottom and side panels each having a respective aperture therein, wherein each of said top, bottom and side panels is adapted for receiving and connection to a respective side plate in a sealed manner.

6. The pump of claim 5 further comprising an inlet tube connected to one of said plates and disposed over an aperture therein for directing cementitious material into said suction housing.

7. The pump of claim 6 wherein the position of said inlet tube on said suction housing may be changed by moving a plate connected to said inlet tube from a first to a second location on said suction housing.

8. The pump of claim 1 further comprising a cover disposed over said connector to prevent contact of said connector with said cementitious material.

9. The pump of claim 8 wherein said rotor includes a hollow end portion and said drive stage includes a drive shaft, and wherein said connector is disposed within the hollow end portion of said rotor and connects said rotor to said drive shaft, and wherein said cover prevents contact of said drive shaft, connector and hollow end portion of said rotor with the cementitious material.

10. The pump of claim 9 wherein said cover is a gasket.

11. The pump of claim 10 wherein said gasket is comprised of elastomeric material.

12. The pump of claim 11 wherein said gasket is of a hollow, generally cylindrical shape and engages in a sealed manner adjacent ends of said drive shaft and said rotor.

13. A pump for cementitious material comprising:

a sealed drive stage including a drive shaft capable of imparting rotary motion;

a rotor/stator mechanism including a rotor disposed within a stator for displacing cementitious material within and along the length of said stator as said rotor undergoes rotational displacement;

a connector coupling said drive stage to said rotor/stator mechanism for rotationally displacing said rotor;

a sealed suction housing enclosing said connector and connecting said drive stage to said rotor/stator mechanism and adapted to receive cementitious material, wherein rotation of said rotor by said drive stage draws cementitious material from said suction housing for displacement within and discharge from said rotor/stator mechanism, said suction housing including plural removable plates for exposing said connector and an inner portion of said suction housing to facilitate cleaning and repair of the pump; and a lubricant reservoir connected to said suction housing for lubricating said drive shaft.

14. The pump of claim 13 further comprising packing materials disposed within said suction housing and positioned about and engaging said drive shaft, and wherein a lubricant is provided to said packing materials.

15. The pump of claim 14 wherein said suction housing includes a flange connected to said drive stage, and wherein said packing materials and said drive shaft are disposed within said flange.

16. A pump for cementitious material comprising:

a sealed drive stage including a drive shaft capable of imparting rotary motion;

a rotor/stator mechanism including a rotor disposed within a stator for displacing cementitious material within and along the length of said stator as said rotor undergoes rotational displacement;

a connector coupling said drive stage to said rotor/stator mechanism for rotationally displacing said rotor;

a sealed suction housing enclosing said connector and connecting said drive stage to said rotor/stator mechanism and adapted to receive cementitious material, wherein rotation of said rotor by said drive stage draws cementitious material from said suction housing for displacement within and discharge from said rotor/stator mechanism, said suction housing including plural removable plates for exposing said connector and an inner portion of said suction housing to facilitate cleaning and repair of the pump;

a cover disposed over said connector and adjacent ends of said drive shaft and said rotor for preventing contact of said connector, drive shaft and rotor with the cementitious material; and a source of lubricant attached to said suction housing for lubricating said drive shaft.

* * * * *